US010107131B2

(12) United States Patent
Schwarz et al.

(10) Patent No.: US 10,107,131 B2
(45) Date of Patent: Oct. 23, 2018

(54) FAN DRIVE THRUST BALANCE

(71) Applicant: United Technologies Corporation, Hartford, CT (US)

(72) Inventors: Frederick M. Schwarz, Glastonbury, CT (US); Jorn A. Glahn, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 505 days.

(21) Appl. No.: 14/769,959

(22) PCT Filed: Mar. 11, 2014

(86) PCT No.: PCT/US2014/022965

§ 371 (c)(1),
(2) Date: Aug. 24, 2015

(87) PCT Pub. No.: WO2014/164601

PCT Pub. Date: Oct. 9, 2014

(65) Prior Publication Data

US 2016/0010490 A1 Jan. 14, 2016

Related U.S. Application Data

(60) Provisional application No. 61/779,119, filed on Mar. 13, 2013.

(51) Int. Cl.
*F01D 17/26* (2006.01)
*F01D 15/12* (2006.01)
(Continued)

(52) U.S. Cl.
CPC ..... *F01D 17/26* (2013.01); *F01D 3/00* (2013.01); *F01D 3/04* (2013.01); *F01D 5/02* (2013.01);
(Continued)

(58) Field of Classification Search
CPC . F01D 17/26; F01D 5/02; F01D 15/12; F01D 25/16; F01D 3/00; F01D 3/04;
(Continued)

(56) References Cited

U.S. PATENT DOCUMENTS 4,523,891 A * 6/1985 Schwartz ..... B64C 11/38 416/157 R
4,578,018 A 3/1986 Pope
(Continued)

OTHER PUBLICATIONS

Supplementary European Search Report for European Application No. 14778353.4 dated Dec. 1, 2016.
(Continued)

*Primary Examiner* — Mark Laurenzi
*Assistant Examiner* — Mickey France
(74) *Attorney, Agent, or Firm* — Carlson, Gaskey & Olds, P.C.

(57) ABSTRACT

A gas turbine engine according to an exemplary aspect of the present disclosure includes, among other things, a fan section, a shaft including a bearing system, a turbine section in communication with the shaft, a speed change mechanism coupling the fan section to the turbine section and a biasing device configured to apply a biasing force against the shaft.

16 Claims, 2 Drawing Sheets

(51) Int. Cl.

| | |
|---|---|
| ***F01D 25/16*** | (2006.01) |
| ***F01D 5/02*** | (2006.01) |
| ***F01D 3/00*** | (2006.01) |
| ***F01D 3/04*** | (2006.01) |

(52) U.S. Cl.
CPC ..... *F01D 15/12* (2013.01); *F01D 25/16* (2013.01); *F05D 2220/36* (2013.01); *F05D 2240/52* (2013.01); *F05D 2240/60* (2013.01); *F05D 2260/15* (2013.01)

(58) Field of Classification Search
CPC ..... F05D 2240/52; F05D 2240/60; F05D 2260/15; F05D 2220/36; F16C 2360/23; F16C 39/04
USPC ..... 415/1, 104, 122.1, 124.1
See application file for complete search history.

(56) References Cited

U.S. PATENT DOCUMENTS

| | | | |
|---|---|---|---|
| 4,697,981 | A | 10/1987 | Brown et al. |
| 4,864,810 | A | 9/1989 | Hines |
| 5,735,666 | A | 4/1998 | Johnston |
| 5,760,289 | A | 6/1998 | Skottegard |
| 5,862,666 | A | 1/1999 | Liu |
| 6,367,241 | B1 | 4/2002 | Ress, Jr. et al. |
| 7,156,613 | B2 | 1/2007 | Friedl |
| 7,287,384 | B2 | 10/2007 | Fish et al. |
| 7,775,758 | B2 | 8/2010 | Legare |
| 8,182,201 | B2 | 5/2012 | Alecu et al. |
| 8,366,382 | B1 | 2/2013 | Maldoon et al. |
| 2006/0137355 | A1 | 6/2006 | Welch et al. |
| 2007/0084189 | A1 | 4/2007 | Moniz et al. |
| 2007/0289312 | A1 | 12/2007 | Daukant |
| 2010/0247283 | A1 | 9/2010 | Andrew et al. |
| 2011/0000217 | A1 | 1/2011 | Grabowski et al. |

OTHER PUBLICATIONS

International Search Report and Written Opinion for PCT/US2014/022965 dated Jun. 25, 2014.
International Preliminary Report on Patentability for International Application No. PCT/US2014/022965 dated Sep. 24, 2015.

* cited by examiner

FAN DRIVE THRUST BALANCE

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor section and the fan section. The turbine section is connected to the fan section through a shaft.

During periods of elevated or maximum load on conventional gas turbine engines, force from the turbine section pulls the shaft in an aft direction. Generally, this force is at least partially counteracted by the fan section pulling the shaft in a forward direction and bearing assemblies along the shaft.

However, gas turbine engines with a gear train, such as an epicyclic gear train, between the fan section and the turbine section that allows the shaft to rotate faster than the fan section, separate the axial loads carried by the fan section and the turbine section. This separation of axial loads occurs because the epicyclic gear train carries torsional loads and not axial loads. Therefore, the fan section no longer counteracts forces pulling the turbine section in the aft direction. Thus, the bearing assemblies along the shaft must support the increased load which results in increased bearing size or decreased bearing life.

SUMMARY

A gas turbine engine according to an exemplary aspect of the present disclosure includes, among other things, a fan section, a shaft including a bearing system, a turbine section in communication with the shaft, a speed change mechanism coupling the fan section to the turbine section and a biasing device configured to apply a biasing force against the shaft.

In a further non-limiting embodiment of the foregoing gas turbine engine, the biasing device includes a chamber defined by a portion of the shaft and a static structure of the gas turbine engine.

In a further non-limiting embodiment of either of the foregoing gas turbine engines, the engine includes a compressed air conduit in communication with the chamber and a compressor section of the gas turbine engine.

In a further non-limiting embodiment of any of the foregoing gas turbine engines, the compressed air conduit includes a valve configured to selectively control the amount of compressed air entering the chamber.

In a further non-limiting embodiment of any of the foregoing gas turbine engines, the biasing device includes a hydraulic press in communication with the shaft.

In a further non-limiting embodiment of any of the foregoing gas turbine engines, the engine includes a fluid conduit in communication with the hydraulic press configured to pressurize the hydraulic press to apply a compressive force against the shaft. The fluid conduit includes a valve configured to selectively control the amount of hydraulic fluid entering the hydraulic press.

In a further non-limiting embodiment of any of the foregoing gas turbine engines, the biasing device includes an electromagnetic press.

In a further non-limiting embodiment of any of the foregoing gas turbine engines, the bearing system includes at least one thrust bearing.

In a further non-limiting embodiment of any of the foregoing gas turbine engines, the turbine section includes at least a low pressure turbine and a high pressure turbine; the shaft connects the low pressure turbine to the speed change mechanism.

In a further non-limiting embodiment of any of the foregoing gas turbine engines, the speed change mechanism is a geared architecture.

A gas turbine engine according to an exemplary aspect of the present disclosure includes, among other things, a shaft including a bearing system, a turbine section in communication with the shaft and a biasing device including an actuator configured to apply a biasing force against the shaft.

In a further non-limiting embodiment of the foregoing gas turbine engine, the biasing device includes a hydraulic press in communication with the shaft.

In a further non-limiting embodiment of either of the foregoing gas turbine engines, the engine includes a fluid conduit in communication with the hydraulic press configured to pressurize the hydraulic press to apply a compressive force against the shaft. The fluid conduit includes a valve configured to selectively control the amount of hydraulic fluid entering the hydraulic press.

In a further non-limiting embodiment of any of the foregoing gas turbine engines, the biasing device includes an electromagnetic press.

A method of balancing a load in a geared turbofan engine according to another exemplary aspect of the present disclosure includes, among other things, applying an axial load to a shaft in a first axial direction in response to an operating condition on the geared turbofan engine and applying a biasing force to the shaft in a second axial direction with a biasing device, the second axial direction being opposite to the first axial direction.

In a further non-limiting embodiment of the foregoing method, the biasing force is applied during periods of elevated or maximum engine load.

In a further non-limiting embodiment of either of the foregoing methods, the biasing device is disabled during normal operating conditions of the geared turbofan engine.

In a further non-limiting embodiment of any of the foregoing methods, the biasing device includes a chamber defined by the shaft and a static structure of the geared turbofan engine.

In a further non-limiting embodiment of any of the foregoing methods, the biasing device includes a hydraulic press in communication with the shaft.

In a further non-limiting embodiment of any of the foregoing methods, the biasing device includes an electromagnetic press in communication with the shaft.

The various features and advantages of this disclosure will become apparent to those skilled in the art from the following detailed description. The drawings that accompany the detailed description can be briefly described as follows.

DETAILED DESCRIPTION

Figure 1:
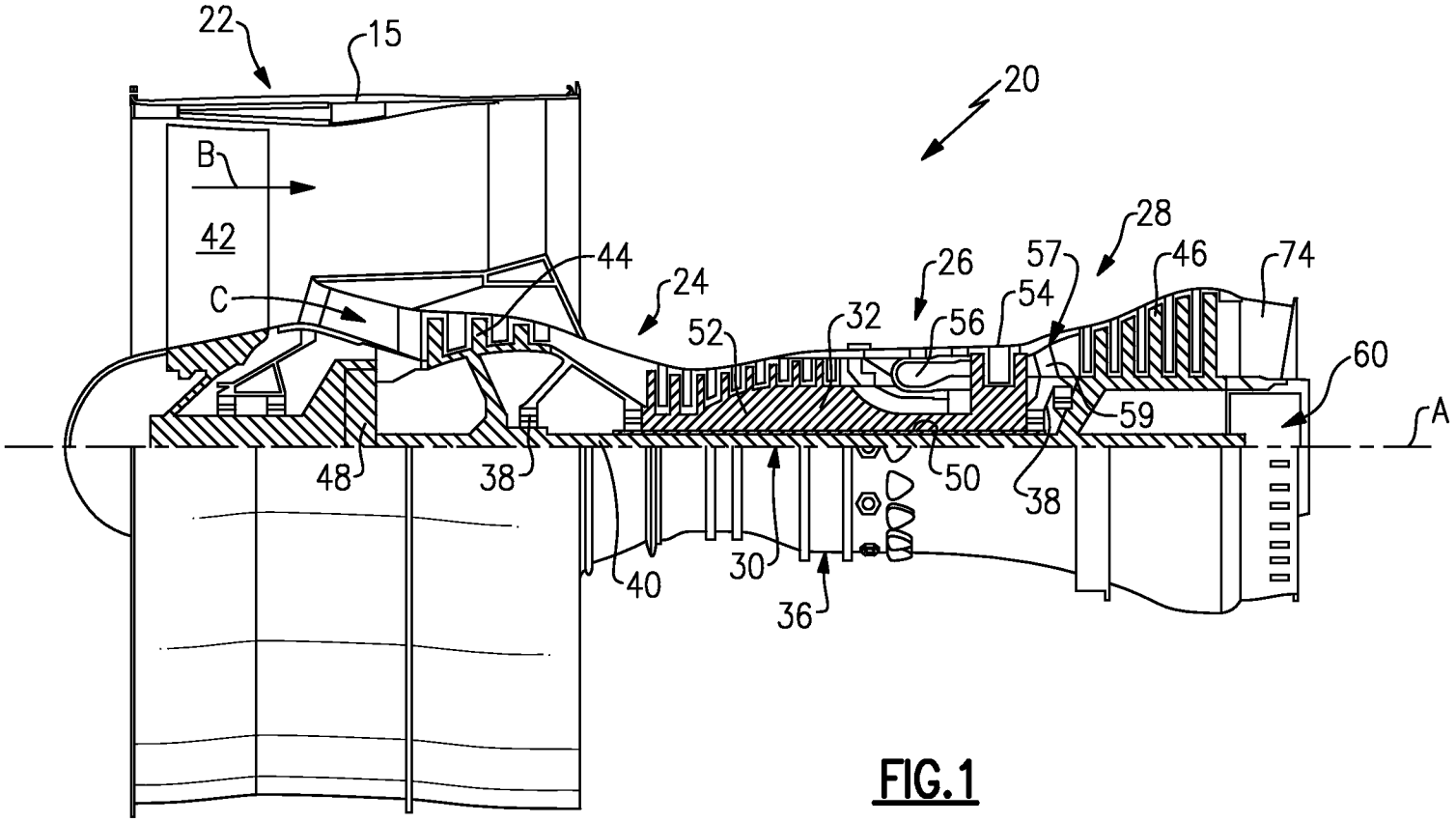
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a fan case 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38, such as a thrust bearing. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine engine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes. Although depicted as a two-spool geared turbofan engine in the disclosed non-limiting embodiment, it should be understood that the concepts described herein are not limited to use with two-spool turbofans as the teachings may be applied to other types of turbine engines including geared three-spool architectures.

The core airflow is compressed by the low pressure compressor 44 then the high pressure compressor 52, mixed with fuel and burned in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 50 may be varied. For example, gear system 50 may be located aft of the combustor section 26 or even aft of turbine section 28, and fan section 22 may be positioned forward or aft of the location of geared architecture 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicyclic gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

The engine 20 includes an example biasing device 60. The example biasing device 60 counteracts the forces of the turbine section 28 pulling the inner shaft 40 in an aft direction and balances a load experienced by the bearing systems 38. In conventional direct drive gas turbine engines, the fan section will at least partially counteract the aftward pull of the turbine section. However, the engine 20 includes the geared architecture 48 which separates axial loads between the fan section 22 and the turbine section 28 because the geared architecture 48 supports torsional loads and not axial loads. Therefore, the fan section 22 does not counteract the load from the turbine section 28. Thus, the bearing systems 38 along the inner shaft 40 must carry this additional load.

Figure 2:
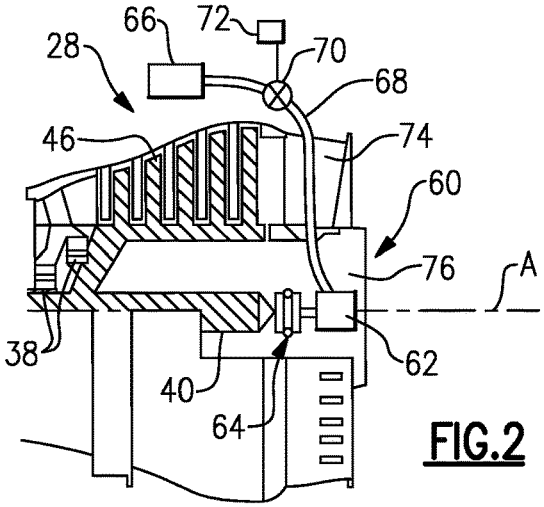
FIG. 2 illustrates an example biasing device.

FIG. 2 illustrates the example biasing device 60 including an actuator, such as a hydraulic press 62, in communication with the inner shaft 40. The hydraulic press 62 is fixedly attached a static structure 76 of the engine 20 and rotatably attached to the inner shaft 40 through a rotating bearing assembly 64. The rotating bearing assembly 64 allows the hydraulic press 62 to remain stationary while applying a compressive force to the rotating inner shaft 40.

A hydraulic fluid source 66 is in fluid communication with the hydraulic press 62 through a fluid conduit 68 that extends through an exit guide vane 74 downstream of the turbine section 28. The fluid conduit 68 may include shielding to protect the fluid against the elevated air temperature passing around the exit guide vane 74.

A controller 72 selectively opens and closes a valve 70 in response to an operating condition of the engine 20 to supply or terminate hydraulic fluid flow to the hydraulic press 62.

For example, during maximum or elevated engine load, the valve 70 opens and hydraulic fluid flows through the fluid conduit 68 to the hydraulic press 62 to force to the inner shaft 40 in the forward direction. The forward directed force on the inner shaft 40 counteracts the forces acting in the aft direction on the inner shaft 40 from the turbine section 28 during the maximum or elevated engine load. Once the period of maximum or elevated engine load terminates and the engine 20 returns to normal operating conditions, the controller 72 closes the valve 70 so that hydraulic fluid no longer travels to the hydraulic press 62 to apply a force to the inner shaft 40 in the forward direction. The forces from the turbine section 28 pulling in the aft direction during normal operating conditions, are carried by the bearing assemblies 38 along the inner shaft.

Figure 3:
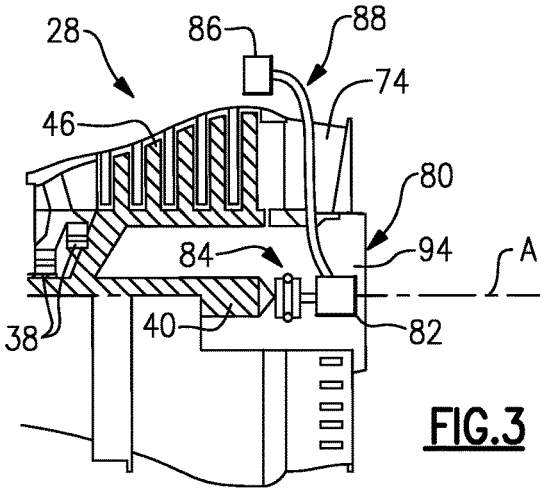
FIG. 3 illustrates another example biasing device.

FIG. 3 illustrates another example biasing device 80 including an actuator, such as electromagnetic press 82, in communication with the inner shaft 40. The electromagnetic press 82 is fixedly attached to a static structure 94 of the engine 20 and rotatably attached to the inner shaft 40 through a rotating bearing assembly 84. The rotating bearing assembly 84 allows the electromagnetic press 82 to remain stationary while applying a compressive force to the rotating inner shaft 40.

An electrical power source 86 is in electrical communication with the electromagnetic press 82 through an electrical connection 88 that extends through the exit guide vane 74 downstream of the turbine section 28. The electrical connection 74 may include shielding to protect the electrical connection 88 against the elevated air temperature passing around the exit guide vane 74.

The electrical power source 86 selectively connects or disconnects power to the electromagnetic press 82 in response to an operating condition of the engine 20. For example, during elevated or maximum engine load, the electrical power source 86 transmits power through the electrical connection 88 to extend the electromagnetic press 62 to apply a force to the inner shaft 40 in the forward direction. The forward acting force counteracts the turbine section 28 pulling the inner shaft 40 in the aft direction during elevated or maximum engine load. Once the period of elevated or maximum load has terminated and the engine 20 returns to normal operating conditions, the electrical power source 86 disconnects power to the electromagnetic press 82 so that it no longer applies a compressive force to the inner shaft 40 in a forward direction.

Figure 4:
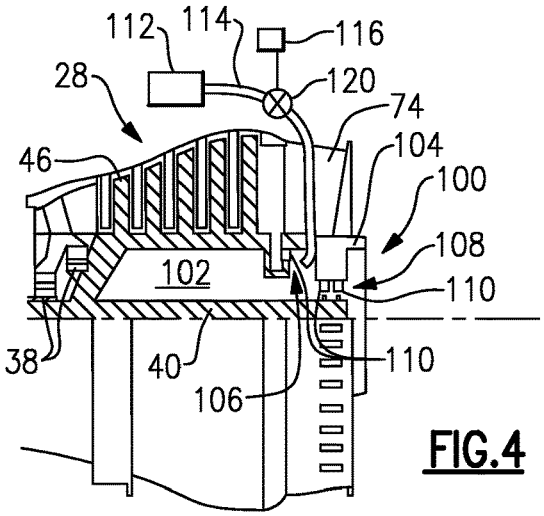
FIG. 4 illustrates yet another example biasing device.

FIG. 4 illustrates the example biasing device 100 including a chamber 102 formed adjacent an aft section of the inner shaft 40 and a static structure 104 of the engine 20. A first knife edge 106 and a second knife edge 108 create a seal between the rotating inner shaft 40 and the static structure 104. The first knife edge 106 and the second knife edge 108 include at least one honeycomb structure 110 to aid in preventing air from leaking from the chamber 102. In this example, the first knife edge 106 includes a single knife edge and honeycomb structure 110 and the second knife edge 108 includes two knife edges each adjacent honeycomb structures 110. However, various numbers of knife edges and honeycomb structures may be used with the first knife edge 106 and the second knife edge 108. Other sealing mechanisms are also contemplated.

A compressed fluid source 112 is in fluid communication with the chamber 102 through a fluid conduit 114 that extends through the exit guide vane 74 downstream of the turbine section 28 into the chamber 102. In this example, the compressed fluid source 112 is supplied with compressed air from the compressor section 24 (FIG. 1).

A controller 116 selectively opens and closes a valve 120 in response to an operating condition of the engine 20. For example, during elevated or maximum load on the engine 20, the valve 120 is opened and fluid travels through the fluid conduit 114 to pressurize the chamber 102 to apply a force to the inner shaft 40 in the forward direction. The chamber 102 applies a force in the forward direction because the aft part of the chamber 102 is formed by the static structure 104. The forward acting force counteracts the turbine section 28 pulling the inner shaft 40 in the aft direction during elevated or maximum load. Once the period of elevated or maximum load has terminated and the engine 20 returns to normal operating conditions, the controller 116 closes the valve 120 so that compressed fluid no longer travels into the chamber 102 to force the inner shaft 40 in the forward direction.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A gas turbine engine comprising:
- a fan section;
- a shaft including a bearing system;
- a turbine section in communication with the shaft;
- a speed change mechanism coupling the fan section to the turbine section;
- a biasing device including an actuator configured to apply a biasing force against the shaft; and
- a rotating bearing assembly configured to allow the actuator to remain stationary while applying a compressive force to the shaft.

2. The gas turbine engine of claim 1, wherein the biasing device includes a hydraulic press in communication with the shaft.

3. The gas turbine engine of claim 2, including a fluid conduit in communication with the hydraulic press configured to pressurize the hydraulic press to apply a compressive force against the shaft, wherein fluid conduit includes a valve configured to selectively control the amount of hydraulic fluid entering the hydraulic press.

4. The gas turbine engine of claim 1, wherein the biasing device includes an electromagnetic press.

5. The gas turbine engine of claim 1, wherein the bearing system includes at least one thrust bearing.

6. The gas turbine engine of claim 1, wherein the turbine section includes at least a low pressure turbine and a high pressure turbine; the shaft connects the low pressure turbine to the speed change mechanism.

7. The gas turbine engine of claim 1, wherein the speed change mechanism is a geared architecture.

8. A gas turbine engine comprising:
- a shaft including a bearing system;
- a turbine section in communication with the shaft;
- a biasing device including an actuator configured to apply a biasing force against the shaft; and
- a rotating bearing assembly configured to allow the actuator to remain stationary while applying a compressive force to the shaft.

9. The gas turbine engine of claim 8, wherein the biasing device includes a hydraulic press in communication with the shaft.

10. The gas turbine engine of claim 9, including a fluid conduit in communication with the hydraulic press configured to pressurize the hydraulic press to apply a compressive force against the shaft, wherein fluid conduit includes a valve configured to selectively control the amount of hydraulic fluid entering the hydraulic press.

11. The gas turbine engine of claim 8, wherein the biasing device includes an electromagnetic press.

12. A method of balancing a load in a geared turbofan engine comprising:

applying an axial load to a shaft in a first axial direction in response to an operating condition on the geared turbofan engine; and applying a biasing force to the shaft in a second axial direction with a biasing device including an actuator configured to apply a biasing force against the shaft, the second axial direction being opposite to the first axial direction, wherein a rotating bearing assembly is configured to allow the actuator to remain stationary while applying a compressive force to the shaft.

13. The method of claim 12, wherein the biasing force is applied during periods of elevated or maximum engine load.

14. The method of claim 12, wherein the biasing device is disabled during normal operating conditions of the geared turbofan engine.

15. The method of claim 13, wherein the biasing device includes a hydraulic press in communication with the shaft.

16. The method of claim 12, wherein the biasing force is directed axially forward.

* * * * *